US006042411A

United States Patent [19]

Choy

[11] Patent Number: 6,042,411

[45] Date of Patent: Mar. 28, 2000

[54] CONNECTOR WITH LATCH DEVICE

[75] Inventor: Edmond Choy, Union City, Calif.

[73] Assignee: Hon Ha Precision Ind. Co., Ltd., Taipei Hsien, Taiwan

[21] Appl. No.: 09/041,880

[22] Filed: Mar. 12, 1998

[51] Int. Cl.[7] ..... H01R 13/62

[52] U.S. Cl. ..... 439/328; 439/326

[58] Field of Search ..... 439/325–328, 439/629, 630

[56] References Cited

U.S. PATENT DOCUMENTS

| | | | |
|---|---|---|---|
| 5,669,782 | 9/1997 | Yodogawa | 439/327 |
| 5,690,502 | 11/1997 | Mochizuki | 439/326 |
| 5,718,594 | 2/1998 | Tondreault et al. | 439/326 |
| 5,888,086 | 3/1999 | Yaegashi et al. | 439/326 |

*Primary Examiner*—Hien Vu

[57] ABSTRACT

An electrical connector includes an elongated insulative housing defining a central slot to receive a module therein. A plurality of contacts are provided by two sides of the central slot for mechanical and electrical engagement with the corresponding circuit pads on the module. A pair of platforms are provided adjacent two opposite ends of the housing. A pair of latch devices are provided at two opposite ends of the housing wherein each latch device includes a plastic member and a metal member. The plastic member integrally extends forward from the housing with a locking head proximate the distal free end thereof. The metal member includes a horizontal plate interferentially received within the corresponding platform, and a vertical plate closely positioned by the outer side of the plastic member. A horizontal bend extends inward from a lower edge of the vertical plate with an upward extending tag so as to not only reinforce the vertical plate but also link up the vertical plate and the plastic member together, allowing for co-lateral movement of the plastic member and the vertical plate. A pair of wings extend from a middle portion of two outermost ends of the housing to provide a stopper wall for preventing over-lateral movement of the plastic member and the associated vertical plate, while still leaving a significant space by two opposite ends of the main body of the housing for allowing other electrical components to be mounted on the PC board thereabouts.

4 Claims, 4 Drawing Sheets

CONNECTOR WITH LATCH DEVICE

BACKGROUND OF THE INVENTION

1. Field of The Invention

The invention relates to connectors, and particularly to the connector with latch devices at two opposite ends wherein each latch device includes the plastic member and the metal member in cooperation with each other.

2. The Related Art

U.S. patent applications Ser. No. 08/627,143 filed Apr. 3, 1996 now U.S. Pat. No. 5,759,057 and Ser. No. 08/692,823 filed on Jul. 29, 1996, now U.S. Pat. No. 5,755,585 disclose the so-called SO DIMMs (Small Outline Dual In-line memory modules), wherein the former discloses the latch device thereof essentially consisting of the plastic member and the metal member, and the latter discloses a high profile style thereof. Because it is desired to have a minimized dimension along the lengthwise direction of the connector, the structure disclosed in the aforementioned applications is required to be modified. It is understood that the main body of the housing of the connector can hardly be changed due to the necessity for compliance with the circuit layout of the inserted module, and thus reducing the dimension of the latch device at either end of the housing is regarded as only one way to implementation of miniaturization.

Therefore, an object of the invention is to provide a connector with latch devices at two opposite ends wherein each latch device includes a plastic member and a metal member while keeping a minimum dimension thereof.

SUMMARY OF THE INVENTION

According to an aspect of the invention, an electrical connector includes an elongated insulative housing defining a central slot to receive a module therein. A plurality of contacts are provided by two sides of the central slot for mechanical and electrical engagement with the corresponding circuit pads on the module. A pair of platforms are provided adjacent two opposite ends of the housing. A pair of latch devices are provided at two opposite ends of the housing wherein each latch device includes a plastic member and a metal member. The plastic member integrally extends forward from the housing with a locking head proximate the distal free end thereof. The metal member includes a horizontal plate interferentially received within the corresponding platform, and a vertical plate closely positioned by the outer side of the plastic member. A horizontal bend extends inward from a lower edge of the vertical plate with an upward extending tag so as to not only reinforce the vertical plate but also link up the vertical plate and the plastic member together, allowing for co-lateral movement of the plastic member and the vertical plate. A pair of wings extend from a middle portion of two outermost ends of the housing to provide a stopper wall for preventing over-lateral movement of the plastic member and the associated vertical plate, while still leaving a significant space by two opposite ends of the main body of the housing for allowing other electrical components to be mounted on the PC board thereabouts.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
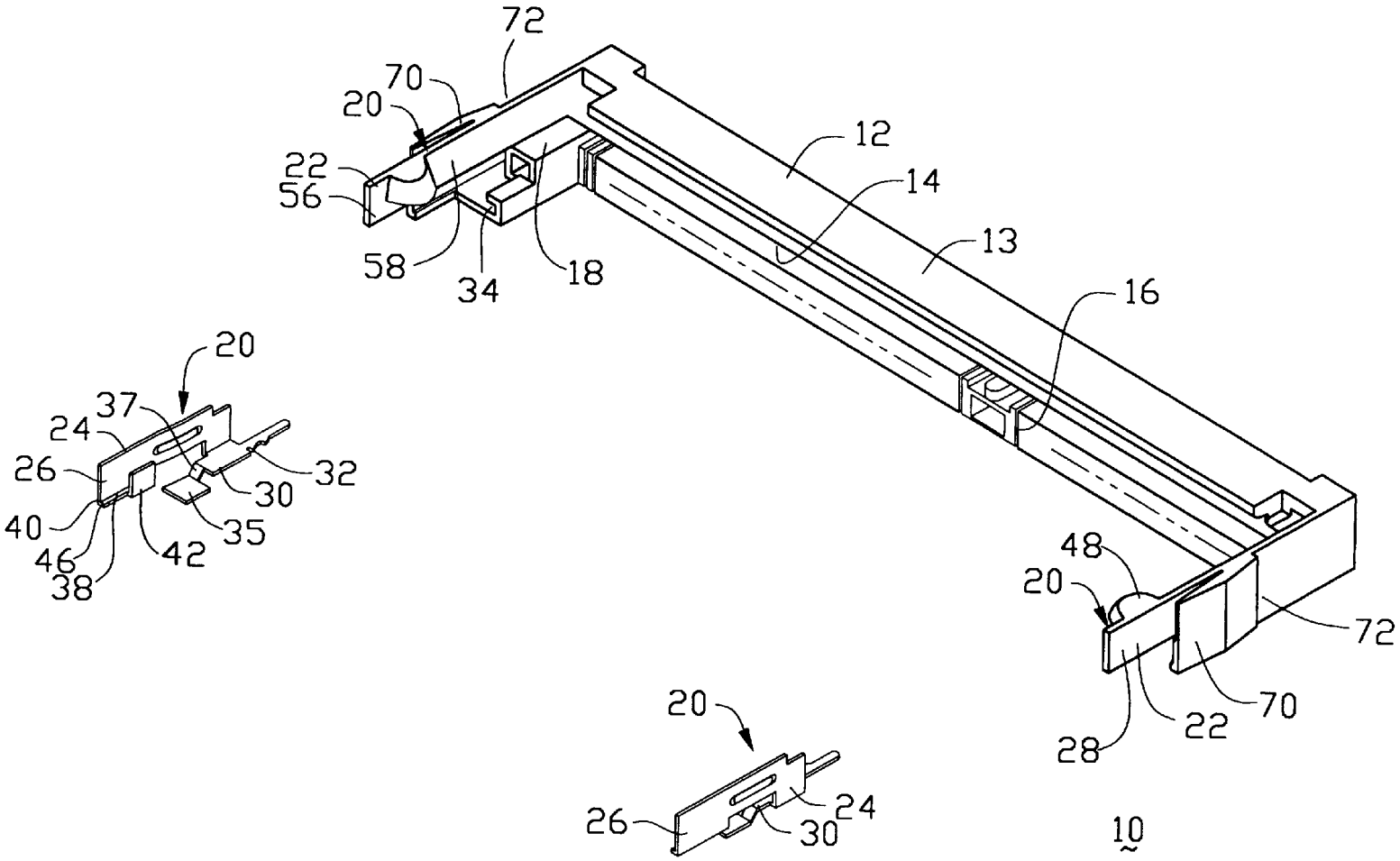
FIG. 1 is an exploded top perspective view of a present preferred embodiment of an electrical connector, according to the invention.
Figure 2:
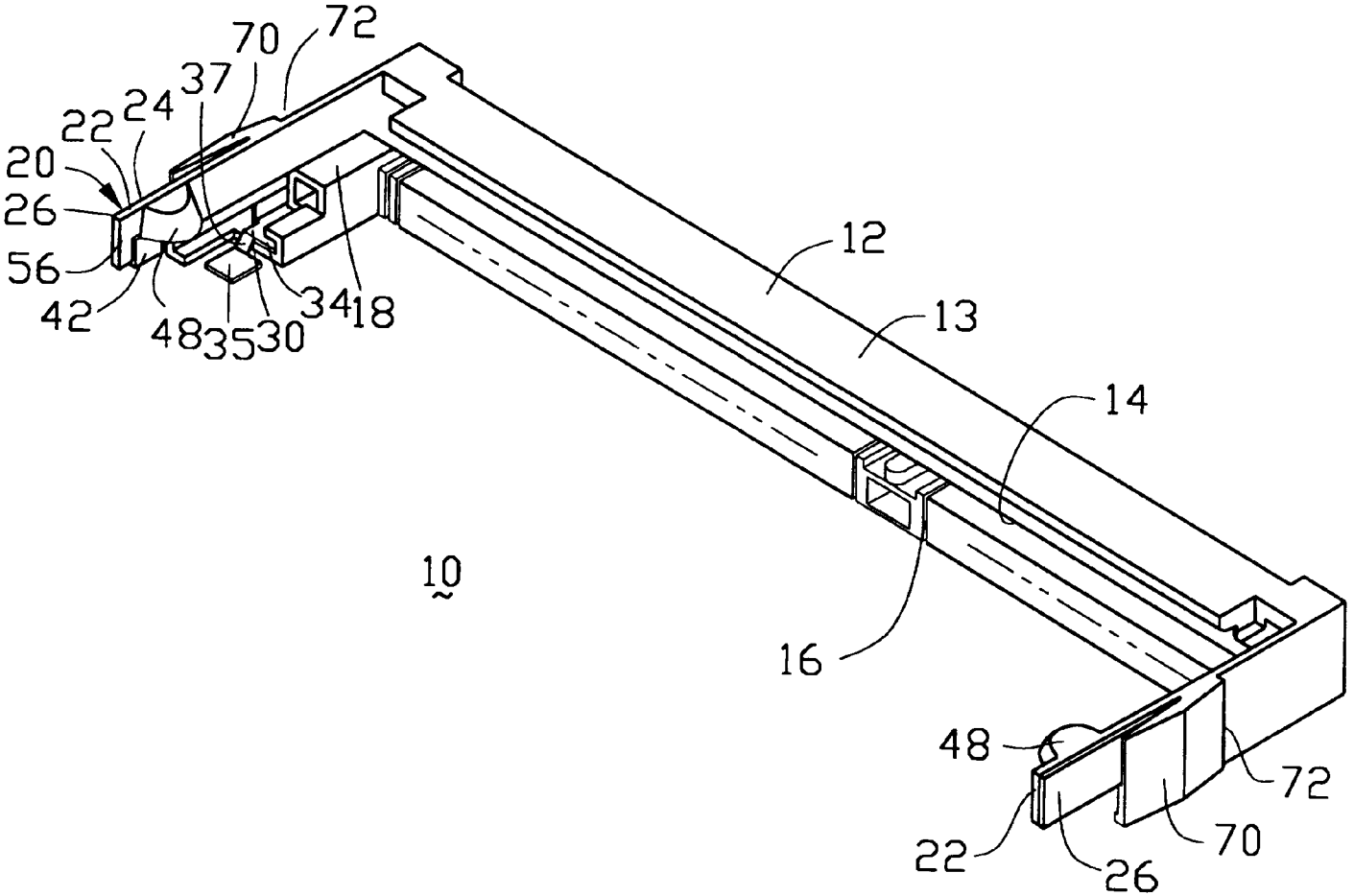
FIG. 2 is a top perspective view of the assembled connector of FIG. 1.
Figure 3:
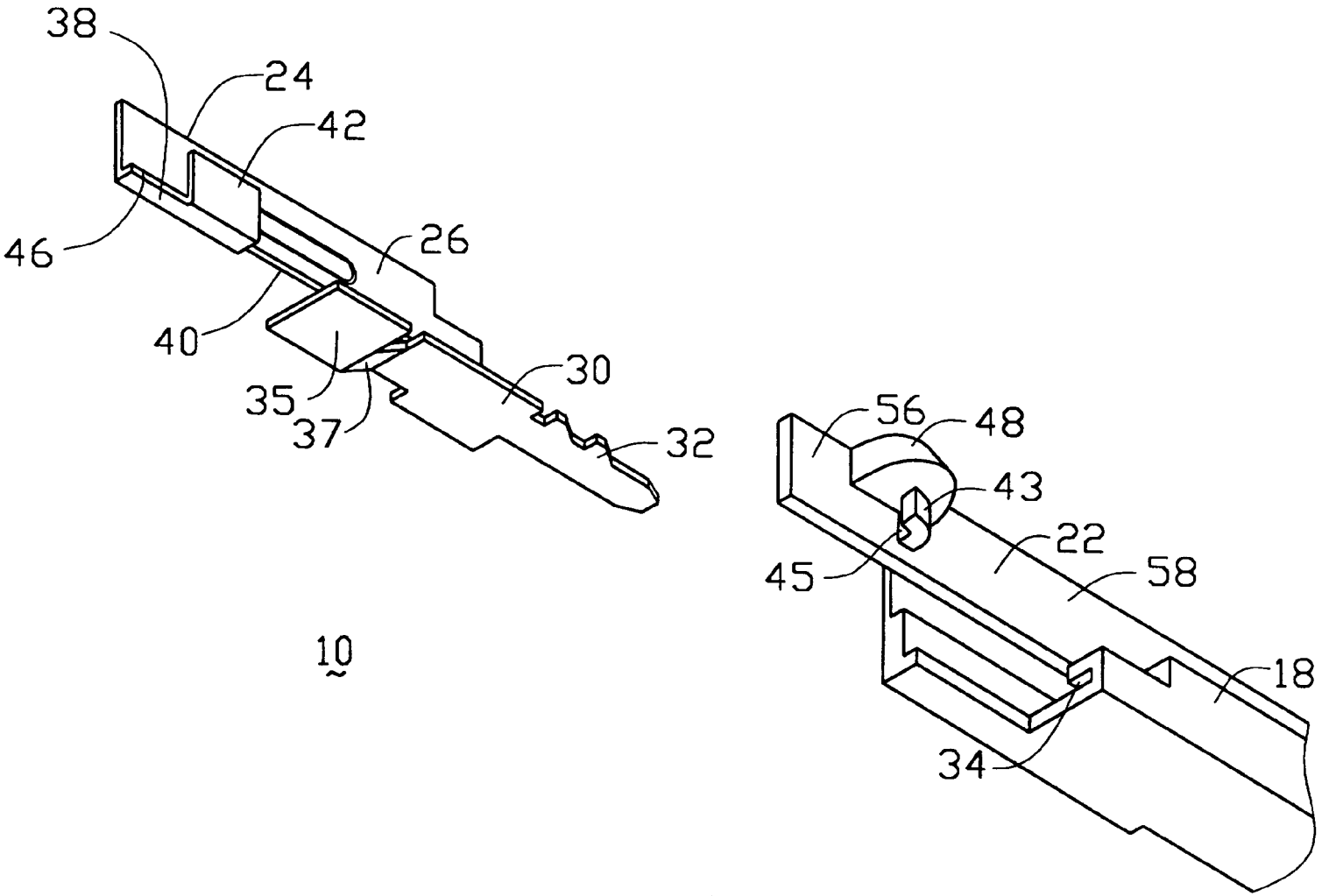
FIG. 3 is an enlarged partially fragmental bottom perspective view of the connector of FIG. 1.
Figure 4:
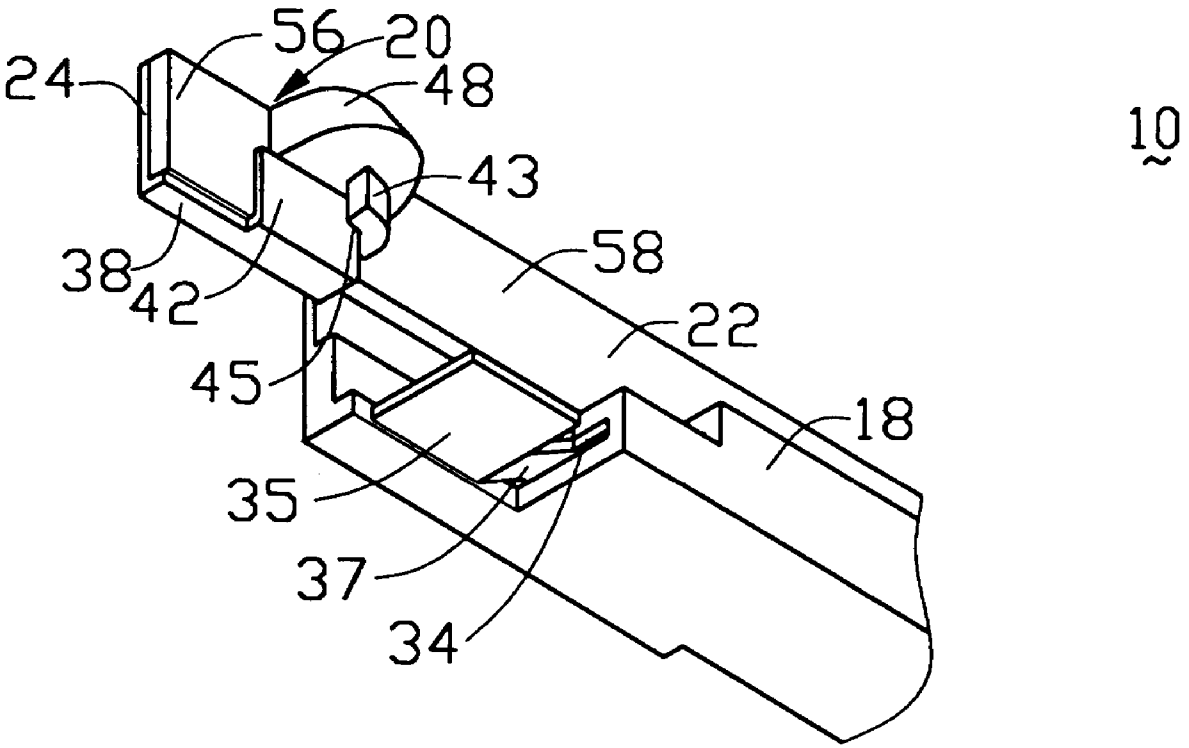
FIG. 4 is an assembled view FIG. 3.

Attention is directed to FIGS. 1–4 wherein an electrical connector 10 includes an elongated insulative housing 12 defining a central slot 14 for receiving a module therein. A plurality of passageways 16 are provided by two sides of the central slot 14 for receiving a corresponding number of contacts (not shown while referring to the aforementioned application Ser. No. 08/692,823 filed on Jul. 29, 1996 now U.S. Pat. No. 5,755,585) so that the contacts can be electrically and mechanically engaged with the corresponding circuit pads on the module 100.

A platform 18 is provided adjacent to either end of the housing 12. A latch device 20 is positioned at either end of the housing 12 and substantially positioned on the outer side of the corresponding platform 18. Each latch device 20 includes a plastic member 22 integrally extending forward from the housing 12 and generally above the corresponding platform 18, and a metal member 24 associated with the plastic member 22.

The metal member 24 includes a vertical plate 26 closely/tightly abutting against the outer surface 28 of the plastic member 22, and a horizontal plate 30 with barbs 32 on the rear portion thereof for retainable engagement within a corresponding aperture 34 in the platform 18 so as to retain the metal member 24 in position with regard to the housing 12 and a forwardly extending solder pad 35 for mounting the connector 10 on a PC board (not shown).

A horizontal bend 38 is formed on the bottom lower edge 40 of the vertical plate 26 to form the whole structure thereof as an angle bar for reinforcement of the vertical plate 26. An upward tag 42 respectively extend from the inner edge 46 of the bend 38 wherein the upward tag 42 generally under a locking head 48 of the plastic member 22. An arch-like protrusion 43 is positioned under the locking head 48 for being compliantly received within a notch of the module (not shown), and forms a groove 45 for receiving the tag 42 therein.

The horizontal plate 30 further includes a downward extension 37 at its foremost end with the solder pad 35 at the bottom which is adapted to be mounted to the corresponding circuit paste of the PC board (not shown) on which the connector 10 is mounted.

A pair of wings 70 forwardly extends from outside middle portions of opposite ends of the housing 12. Each wing 70 serves as a stopper wall for preventing excessive outward movement of the plastic member 22 thereby protecting the plastic member 22 from damage. A space 72 is defined rearward of each wing 70 and beside the corresponding end of a main body 13 of the housing 12 along an axis of the main body 13. The space 72 is adapted for allowing other electrical components (not shown) to be mounted on the PC board closely beside the card connector thereby making efficient use of such space 72 and reducing occupied space on the PC board.

It can be understood that after assembled, when the module is retainably received within the connector 10, the module is locked by the locking head 48 of the plastic member 22. Afterwards, the model can be released from the connector 10 by manually outward pressing a lever end 56 of the plastic member 22 and having the plastic member 22 outward deflected with the locking head 48 disengaged from the module.

It can be noted the vertical plate 26 of the metal member 24 is moved along with the plastic member 22 because the upward tag 42 abutting against an inner surface 58 of the plastic member 22 cooperates with the vertical plate 26 abutting against the outer surface 28 of the plastic member 22. It is appreciated that the inner surface 58 of the plastic member 22 should designedly abut against the side edge of the module, and since the upward tag 42 is generally positioned under the locking head 48 of the plastic ember 22 and will be receivably positioned within the corresponding notch of the module, such upward tag 42 will not improperly interfere with the module.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. An electrical connector comprising:

an elongated insulative housing defining a central slot for receiving a module;

a pair of platforms provided adjacent to two opposite ends of the housing;

a pair of latch devices provided at two opposite ends of the housing beside the corresponding platforms;

each of said latch devices including a plastic member and a metal member;

said plastic member integrally and forwardly extending from the housing and having a locking head formed thereon; and said metal member including a vertical plate and a horizontal plate retaining the metal member in position with the platform and being mounted to a printed circuit board; wherein an upward tag is formed with the vertical plate and is positioned under said locking head of the plastic member, said upward tag abutting against an inner surface of the plastic member and the vertical plate abutting against an outer surface of the plastic member thereby connecting the vertical plate with the plastic member, thus to provide co-lateral movement of the plastic member and the vertical plate of the metal member, and wherein the vertical plate of the metal member comprises a horizontal bend formed on a lower edge thereof for reinforcement, and the up-ward tag extends from said bend.

2. The connector as defined in claim 1, wherein said horizontal plate includes a downward extension with a solder pad forwardly extending therefrom.

3. The connector as defined in claim 1, wherein the housing comprises a wing forwardly extending from a middle portion of each end thereof to leave a space rearward of said wing and beside the end of a main body of the housing to accommodate other electrical components, the wing serving as a stopper wall to prevent an excessive outward movement of the plastic member.

4. The connector as defined in claim 1, wherein the plastic member has an arch like protrusion formed under the locking head for engaging with a notch of an inserted module, said protrusion forming a groove for receiving said upward tag therein.

* * * * *